United States Patent [19]

Binge

[11] 4,290,168

[45] Sep. 22, 1981

[54] HINGE CONSTRUCTION WITH POSITIVE LOCKING MEANS

[75] Inventor: Derek S. Binge, Hamilton Square, N.J.

[73] Assignee: RCA Corporation, New York, N.Y.

[21] Appl. No.: 84,587

[22] Filed: Oct. 15, 1979

[51] Int. Cl.[3] ..... E05D 1/06; E05D 7/10

[52] U.S. Cl. ..... 16/175; 403/96; 403/327; 16/141; 16/144

[58] Field of Search ..... 16/175, 141, 144, 147; 403/96, 327, 358, 409

[56] References Cited

U.S. PATENT DOCUMENTS

| | | | |
|---|---|---|---|
| 2,610,584 | 9/1952 | Calder | 403/409 X |
| 3,744,085 | 7/1973 | Griego | 16/144 |
| 4,109,251 | 8/1978 | MacDougall | 403/96 X |
| 4,216,844 | 8/1980 | Klats | 16/144 X |

*Primary Examiner*—Wayne L. Shedd
*Attorney, Agent, or Firm*—Samuel Cohen; William Squire

[57] ABSTRACT

The shaft of a hinge is fixed to one of the hinge elements and is both rotatable and is moveable in the direction of its axis relative to the other hinge element. The shaft is formed with a detent element at one end thereof which is engageable with a second detent element which is fixed relative to the other hinge element, when the shaft is in a particular rotational orientation and is moved axially in the direction of the second detent element. The shaft is axially biased toward the second detent element and its one end is conically shaped and engageable with a conically shaped brake surface fixed to the other hinge element when the two detent elements mate.

15 Claims, 5 Drawing Figures

HINGE CONSTRUCTION WITH POSITIVE LOCKING MEANS

Figure 2:
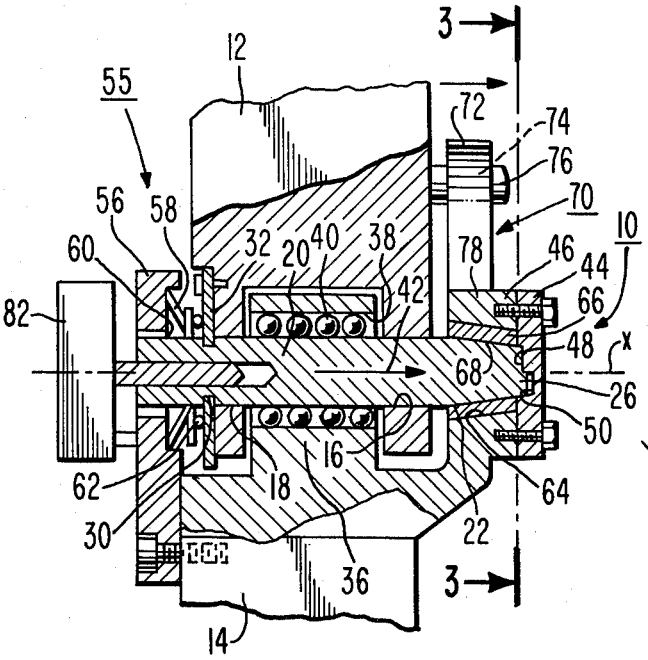

The present invention relates to hinge apparatus including devices for accurately angularly locking two hinge members in a given angular orientation.

The use of detent mechanisms for angularly orienting one hinge member with respect to a second hinge member are well known. One such hinge member may include a leaf spring with a projection protruding from the end of the spring. The spring projection may ride over a cam surface which is secured to one hinge member, the leaf spring being secured to the other hinge member. A recess in the cam surface receives the projection when they are aligned. When so aligned, the projection drops into the recess locking the two members in the desired angular position. A problem with this arrangement is that there must be sufficient clearance for the projection to drop into the recess. This clearance introduces backlash between the two hinge members. In some implementations, such backlash is undesired.

Other implementations of detent devices use concave recesses and spring loaded balls. A problem with this construction is that the spring loaded balls, when subjected to torsional forces, may be forced out of their detent recesses. Other detect systems may use additional cams or levers for locking the hinge members together in a given angular orientation, once positioned in that orientation by detent means such as that described above. These additional levers and locking devices, of course, add complexity and cost to the hinge joint.

Still other arrangements utilize pawl and ratchet configurations. In these, the pawl is spring biased into engagement with the ratchet, which may be formed on one of the hinge members, the pawl being secured to the other hinge member. A problem with this arrangement is that when the hinge members are rotated with respect to each other in one direction, the pawl is automatically disengaged. It is only when they are attempted to be rotated in the other direction are they locked. This action is not desirable where positive locking action to the hinge members is required for preventing rotation of the hinge members in either direction.

In a hinge joint construction embodying the present invention, a first hinge member is rotatably secured to a second hinge member about an axis and is slidably secured to the second member for displacement in a first direction parallel to the axis of rotation. Means are included for urging the first hinge member in the first direction. Means rotate the first member about the axis with respect to the second member from a first angular position to a second angular position. Detent means are secured to the members wherein the detent means align only when the members are in a third angular position with respect to each other, which is between the first and second positions. The first member moves in the first direction to a fourth position when in the third angular position. Friction means are connected to the members and lock together in frictional engagement only when the members are in the fourth position. The frictional engagement insures that no angular displacement occurs between the hinge members when engaged.

Figure 1:
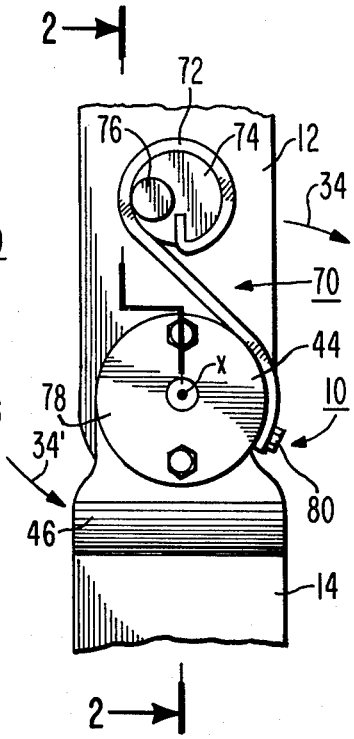
Figure 4:
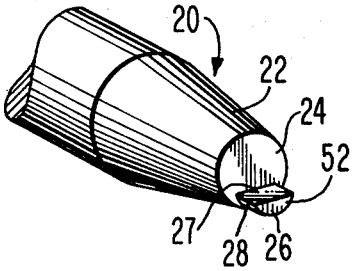
Figure 3:
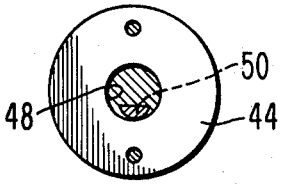
Figure 5:
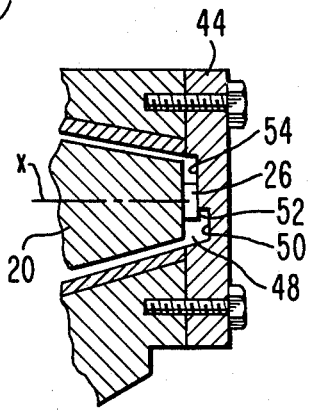

In the drawing:

FIG. 1 is a side elevation view of a hinge joint construction embodying the present invention, FIG. 2 is a sectional side elevation view of the joint construction of FIG. 1, taken along lines 2—2, FIG. 3 is an end elevation view of a detent plate structure taken along lines 3—3 of FIG. 2, FIG. 4 is an isometric view of ths shaft about which the hinge members rotate illustrating the friction locking surface and the detent projection which mates with the plate of FIG. 3, and FIG. 5 is a sectional side elevation view of a portion of the detent mechanism similar to the view of FIG. 2 with the shaft and the detent plate in the unlocked position.

In FIGS. 1 and 2, hinge joint construction 10 includes two hinge members 12 and 14. A shaft 20 is press fitted in aligned apertures 16 and 18 at the end of member 12. The shaft 20 has a conical surface 22 at one end. A projection 26 extends outwardly from the end face 24, FIG. 4, of shaft 20. Projection 26 has a plane inner surface 27 and a curved outer surface 28.

An annular groove 30, FIG. 2, is formed in the cylindrical surface of shaft 20 near the end of the shaft opposite the end with the conical surface 22. An annular plate 32 secures the shaft 20 to member 12 via groove 30. Thus, all motions of member 12 are imparted to shaft 20.

Member 14 has a central leg 36 which has an aperture 38 in which is press fitted bushing bearing assembly 40. Bearing assembly 40 permits rotation about the x axis (through shaft 20) and sliding action in direction 42 parallel to the x axis. Bearing assembly 40, also known as a Thompson ball bushing, provides relatively high load capacity, low friction operation, and negligible clearance between mating components. The ball bushing permits both rotational motions and sliding axial motions.

Detent plate 44 is secured to the leg 46 of hinge member 14. Plate 44 has a circular recess 48 for receiving the end face 24 of shaft 20. Located within the recess 48 is a detent recess 50 which is complementary to projection 26. Recesses 48 and 50 are positioned in plate 44 as shown in FIG. 3. The projection 26 and the recess 50 are offset the same distance from the x axis so that detent projection 26 of shaft 20 is received within the detent recess 50 only when the shaft 20 is in a given angular orientation with respect to the plate 44.

When the detent projection is disengaged, as shown in FIG. 5, the end surface 52 of detent projection 26 rides on the surface 54 of recess 48 as the shaft 20 rotates about the x axis with respect to plate 44. When the detent projection 26 and the detent recess 50 are in alignment, the shaft 20 can slide axially within the bearing assembly 40 in the direction 42 to cause projection 26 to engage the recess 50.

To provide the force for axial motion of shaft 20 in direction 42, a spring bias assembly 55 is included. This assembly includes a cover plate 56 which is bolted to member 14. Concave spring 58 which is circular in plan is seated in an annular recess 60 in the inner wall of plate 56. A ring 62 abuts spring 58 and plate 32. Spring 58 is in compression and biases plate 32, member 12, and shaft 20 in direction 42 with respect to member 14, plate 56 and end plate 44. Thus, shaft 20 has its projection 26 surface 52 abutting, under spring load, surface 54, FIG. 5 of plate 44 when the detent is disengaged. Assuming hinge member 14 to be in a reference orientation, when the hinge member 12 rotates in the clockwise direction 34 relative thereto until it reaches the position shown in FIG. 1, that is, a position such that the projection 26 and detent recess 50 become aligned, the spring 58 causes the shaft 20 and hinge member 12 to slide in bearing assembly 40 in the direction 42 and the projection 26 locks in the recess 50.

Leg 46 of hinge member 14 has a conical inner surface 64 to which is attached, for example by an adhesive, a high friction material 66 such as asbestos. The inner conical surface of the high friction material 66 is complementary to the exterior conical surface 22 of shaft 20. The inner surface 68 of the high friction material 66 is dimensioned to engage the conical surface 22 of shaft 20 when the projection 26 enters the detent recess 50. Preferably, the dimensional characteristics of the inner surface 68 of the high friction material and the conical surface 22 of shaft 20 are such that the end surface 24 is spaced somewhat from surface 54 of plate 44 when the detent is engaged. At this time surface 22 of shaft 20 wedges within the inner surface 68 of the high friction material 66.

This wedging action of the two conical surfaces provide tight locking action between the shaft 20 and the leg 46. This locks the hinge member 12 to the hinge member 14, that is, it prevents rotation about the x axis. This locking action eliminates play between the members which would otherwise be present due to clearance space between the detent projection 26 and the detent recess 50 in these directions.

Spring assembly 70, FIGS. 1 and 2, biases the hinge member 12 so that it tends to rotate in direction 34 with respect to member 14, if member 14 is assumed to have a fixed position. In the converse, if member 12 is assumed fixed in position, assembly 70 biases member 14 so it tends to rotate in direction 34′ with respect to member 12. Assembly 70 includes a leaf spring 72 which may be made of spring sheet metal. Spring 72 is wrapped around right circular cylinder member 74. Member 74 is slidably engaged and keyed with a key and keyway arrangement (not shown) on cylindrical shaft 76 attached to a side of hinge member 12. The key and keyway arrangement (not shown) between shaft 76 and the cylindrical member 74 transmits torques about the x axis from member 74 to shaft 76 induced by spring 72. The keying arrangement permits the member 74 to slide in the direction 42 with respect to the shaft 76. The spring 72 is secured to the cylindrical member 74 at one end. The other end of spring 72 is wrapped around right circular cylinder member 78 of leg 46 and secured to member 78 with a screw 80.

In the position illustrated in FIGS. 1 and 2, the hinge members 14 and 12 are shown in the locked position. Member 12 or member 14 is rotated to this position from a previous folded position (not shown) in which the hinge members are restrained by restraining means (not shown). Such restraining means could be a solenoid operated hook device or a strap mechanism released by a pyrotechnic fired cutting device or any other type of restraint mechanism. The spring 72 wraps around cylinder member 78 when the hinge members are in the folded restrained position. To move to the folded position from the position shown in FIG. 1, assuming member 14 is in a fixed position, member 12 is rotated in direction 34′.

It is apparent that other torsion devices may be employed instead of assembly 70. Such other devices may include other types of torsion springs of well known design connected between the hinge members and connected to permit motion between the members in direction 42. Also a stepping motor may be connected between members 12 and 14 to impart relative rotation between the two hinge members. In any case, the detent and friction assembly accurately locates the hinge members in the desired angular position.

In FIG. 2, attached to shaft 20 and plate 56 is a viscous damping apparatus 82. Apparatus 82 dampens abrupt motions between the hinge members 12 and 14, such damping being desirable in some implementations. This permits smooth rotation of the hinge members with respect to each other until the detent mechanism engages and the shaft 20 is locked to leg 46.

The bushing bearing assembly 40 permits the shaft 20 to rotate about the x axis and also permits the shaft 20 to axially slide in the direction 42 parallel to the x axis at the appropriate time. Both of these motions, as indicated above, are with zero play between shaft 20 and the bearing assembly 40.

In the described construction, the detent assembly forming detent projection 26 and detent recess 50 provide angular alignment of the hinge members 12 and 14 with respect to each other in the directions 34 and 34′. Once so aligned, the projection 26 enters the recess 50. This causes the conical surfaces 22 of the shaft 20 and 64 of the high friction brake material 66 to engage and to lock together. Once this locking action occurs, then there is, as is apparent, zero free play between the members in any direction. This zero free play in any direction is important for certain implementations.

For example, in certain communications antennas in which the antennas may be remotely deployed, it may be desired that the antennas be highly directional. This directionality is maintained without looseness and with positive locking action by the present invention since no motion occurs in the locked position between the hinge members 12 and 14.

In an alternate arrangement such as may be used in link assemblies for extending solar array panels in a spacecraft, any motion of the solar panel due to free play between the link members may cause a dynamic imbalance in the spacecraft. This imbalance may require realignment of the attitude control system of the spacecraft. This problem is avoided by apparatus in accordance with the present invention.

It will be apparent to those of ordinary skill that there may be other environments in which looseness between hinge members in a hinge joint construction is not desirable, requires positive locking action, but yet can be operated remotely, with simple elements.

What is claimed is:

1. A hinge joint construction comprising:

a first hinge member, a second hinge member secured to the first member, said second member being rotatable about a pivot axis relative to the first member and axially moveable relative to the first member in a first direction parallel to the axis, friction locking means including detent means and friction means each having engaged and disengaged states, said locking means being coupled to said members for locking said members in a fixed relative angular position only when said first member is in a first relative position along said axis with respect to said second member to thereby place said detent and friction means in the engaged state; said locking means including said friction means and said detent means both being disengaged only when said first member is in a second relative axial position along said axis with respect to said second member, and axial positioning means for axially placing said first member in said first axial position from said first position only when said hinge members are in said fixed angular position.

2. The joint construction of claim 1 wherein said friction locking means includes bias means between said members for urging said second member in said first direction, said friction means including conical complementary surfaces on said members which wedge together only when said hinge members are in said angular position.

3. The joint construction of claim 1 wherein said detent means includes a projection extending axially in said first direction from said second member and offset asymmetrically with respect to said axis, and a detent plate member secured to the first member and having an aperture offset asymmetrically from said axis at said fixed angular position and oriented to receive said projection only when said projection is aligned therewith at said angular position whereby when said projection is aligned with said aperture it engages said aperture and said second member moves axially in said first direction engaging said friction means.

4. The joint construction of claim 1 further including first bias means for rotationally urging one of said hinge members with respect to the other member about said axis and second bias means for axially urging one of said hinge members in said first direction with respect to the other member.

5. The joint construction of claim 4 wherein said second bias means includes torsion spring means coupled between said first and second hinge members.

6. The joint construction of claim 1 further including bearing means connected between said hinge members for slidably and rotationally engaging said members with negligible motion therebetween in a radial direction normal to said first direction.

7. A hinge joint construction comprising:

a first hinge member, a second hinge member rotatably secured to the first member for rotation about an axis and moveably secured to the first member for displacement axially in a first direction parallel to said axis, means for urging said second member in said first direction, means for rotating said first member about said axis with respect to said second member from a first angular position to a second angular position with respect to each other, detent means secured to said members, said detent means aligning only when said members are in a third angular position with respect to each other which is between said first and second positions, said second member moving in said first direction to a fourth position when in said third angular position, and friction engaging means connected to said members and which lock together in frictional engagement only when said detent means are engaged when said members are in said fourth position.

8. An improved construction for a hinge which includes a first hinge member adapted to be fixed to one part, a second hinge member adapted to be fixed to a second part which is moveable relative to the one part, and pivot means for the two hinge members having an axis about which the second hinge member can swing relative to the first hinge member, the improvement comprising:

the pivot means being fixed to one of the hinge members;

means supporting the pivot means relative to the other hinge member for permitting both rotation of the pivot means about its axis and movement of the pivot means in the direction of its axis;

detent means including a first detent element in fixed position relative to said one of said hinge members, and a second detent element in fixed position relatively to said other hinge member, engageable with the first detent element when the pivot means is rotated to a particular angular position and is moved in its axial direction in a sense to urge said first detent element toward said second detent element;

means in fixed position relatively to said other hinge member for preventing the first detent element from moving toward the second detent element except when the pivot means is at said particular angular position;

bias means for continuously urging the pivot means in its axial direction in a sense to urge said first detent element toward said second detent element; and brake means comprising a first brake element in fixed position relative to one of the detent elements and a second brake element in fixed position relatively to the other detent element, said two brake elements being positioned relative to one another so that they move into engagement only when the two detent elements move into engagement.

9. An improved construction as set forth in claim 8 wherein said first brake element comprises a member formed with a conically shaped outer surface, and said second brake element comprises a member formed with a conically shaped inner surface which is mateable with said conically shaped outer surface of said first brake element, one of said surfaces comprising friction material.

10. An improved construction as set forth in claim 8 wherein:

said pivot means comprises a shaft, said first detent element is fixed to one end of said shaft and said shaft is formed with a conical surface at said one end of said shaft; and further including a member fixed relative to said other hinge element having a conical brake surface mateable with the conical surface at the end of the shaft when the shaft is rotated to said particular angular orientation and is moved in the axial direction to cause the first and second detent elements to engage.

11. An improved construction as set forth in claim 10 wherein the first detent element comprises a projection at the end of the shaft and the second detent element comprises a member formed with a recess therein with which said projection is mateable when the shaft is in said particular rotational orientation.

12. A hinge joint construction comprising:

a first hinge member, a second hinge member secured to the first member, said second member being rotatable about a pivot axis relative to the first member and axially moveable relative to the first member in a first direction parallel to the axis, friction locking means including detent means each having engaged and disengaged states, said locking means being coupled to said members for locking said members in a fixed relative angular position when said first member is in a first relative position along said axis with respect to said second member to thereby place said detent and friction means in the engaged state; said locking means being unlocked when said first member is in a second relative axial position along said axis with respect to said second member, and axial positioning means for axially placing said first member in said first axial position from said first position only when said hinge members are in said fixed angular position, said detent means including a projection extending axially in said first direction from said second member and offset asymmetrically with respect to said axis, and a detent plate member secured to the first member and having an aperture offset asymmetrically from said axis at said fixed angular position and oriented to receive said projection only when said projection is aligned therewith at said angular position whereby when said projection is aligned with said aperture it engages said aperture and said second member moves axially in said first direction engaging said friction means.

13. A hinge joint construction comprising:

a first hinge member, a second hinge member secured to the first member, said second member being rotatable about a pivot axis relative to the first member and axially moveable relative to the first member in a first direction parallel to the axis, friction locking means including detent means and friction means each having engaged and disengaged states, said locking means being coupled to said members for locking said members in a fixed relative angular position when said first member is in a first relative position along said axis with respect to said second member to thereby place said detent and friction means in the engaged state; said locking means being unlocked when said first member is in a second relative axial position along said axis with respect to said second member, axial positioning means for axially placing said first member in said first axial position from said first position only when said hinge members are in said fixed angular position, and first bias means for rotationally urging one of said hinge members with respect to the other member about said axis and second bias means for axially urging one of said hinge members in said first direction with respect to the other member.

14. An improved construction for a hinge which includes a first hinge member adapted to be fixed to one part, a second hinge member adapted to be fixed to a second part which is moveable relative to the one part, and pivot means for the two hinge members having an axis about which the second hinge member can swing relative to the first hinge member, the improvement comprising:

the pivot means being fixed to one of the hinge members;

means supporting the pivot means relative to the other hinge member for permitting both rotation of the pivot means about its axis and movement of the pivot means in the direction of its axis;

detent means including a first detent element in fixed position relative to said one of said hinge members, and a second detent element in fixed position relatively to said other hinge member, engageable with the first detent element when the pivot means is rotated to a particular angular position and is moved in its axial direction in a sense to urge said first detent element toward said second detent element;

means in fixed position relatively to said other hinge member for preventing the first detent element from moving toward the second detent element except when the pivot means is at said particular angular position;

bias means for continuously urging the pivot means in its axial direction in a sense to urge said first detent element toward said second detent element;

said pivot means comprising a shaft, said first detent element is fixed to one end of said shaft and said shaft is formed with a conical surface at said one end of said shaft; and a member fixed relative to said other hinge element having a conical brake surface mateable with the conical surface at the end of the shaft when the shaft is rotated to said particular angular orientation and is moved in its axial direction to cause the first and second detent elements to engage, the first detent element comprising a projection at the end of the shaft and the second detent element comprises a member formed with a recess therein with which said projection is mateable when the shaft is in said particular rotational orientation.

15. An improved construction for a hinge which includes a first hinge member adapted to be fixed to a first part, a second hinge member adapted to be fixed to a second part which is moveable relative to the first part, and a shaft passing through the two hinge members having an axis about which the second hinge member swings, the improvement comprising:

the shaft being fixed to one of the hinge members;

means supporting the shaft relative to the other hinge member for permitting both rotation of the shaft about its axis and movement of the shaft in the direction of its axis;

detent means including a first detent element in fixed position relative to said one of the hinge members, and a second detent element in fixed position relative to said other hinge member, engageable with the first detent element when the shaft is rotated to a particular angular position and is moved in its axial direction in a sense to urge said first detent element toward said second detent element;

means fixed relative to said other hinge member for preventing the first detent element from moving toward the second detent element except when the shaft is at said particular angular position;

bias means for continuously urging the shaft in its axial direction in a sense to urge said first detent element toward said second detent element; and brake means including a first brake element in fixed position relative to said one hinge member and a second brake element in fixed position relative to said second hinge member, the two brake elements being positioned to be engageable only when the shaft is moved in its axial direction by said bias means to cause the two detent elements to engage, said first detent element comprising a projection at one end of said shaft, said second detent element comprises a member formed with a recess therein with which said projection mates when the shaft is at said particular angular position, said first brake element comprising the outer surface of said end of said shaft, said outer surface being formed of conical shape, and wherein said second brake element comprises a brake shoe which is engageable by said outer surface when the two detent elements engage.

* * * * *